United States Patent [19]

Miller

[11] Patent Number: 5,072,946

[45] Date of Patent: Dec. 17, 1991

[54] METHOD OF PLAYING A WAGERING CASINO-TYPE CARD GAME

[75] Inventor: Mark M. Miller, Las Vegas, Nev.

[73] Assignee: Yin Yang Yo, Inc., Las Vegas, Nev.

[21] Appl. No.: 575,329

[22] Filed: Aug. 30, 1990

[51] Int. Cl.[5] ..... A63F 1/00

[52] U.S. Cl. ..... 273/292; 273/274

[58] Field of Search ..... 273/274, 292, 307, 393, 273/303, 149 R, 293, 304

[56] References Cited

U.S. PATENT DOCUMENTS

| | | | |
|---|---|---|---|
| 3,667,757 | 6/1972 | Holmberg | 273/274 |
| 4,014,549 | 3/1977 | Cywar | 273/304 |
| 4,119,322 | 10/1978 | Weigl | 273/293 |
| 4,397,469 | 8/1983 | Carter | 273/292 X |
| 4,659,082 | 4/1987 | Greenberg | 273/149 R |

OTHER PUBLICATIONS

"Scarne's New Complete Guide to Gambling", Scarne, J. (New York: Simon and Schuster, 1974), pp. 470–489.

"Hoyle's Modern Encyclopedia of Card Games", Gibson, W. (New York: Doubleday and Company), pp. 32–35, 286–287, 303–304 and 368.

*Primary Examiner*—Edward M. Coven

*Assistant Examiner*—William M. Pierce

*Attorney, Agent, or Firm*—Quirk, Tratos & Roethel

[57] ABSTRACT

The method of playing a game utilizes one or more decks of cards. One card is dealt to a first player and one card is dealt to a second player. The numerical value of the first player's card is compared to the numerical value of the second player's card. If the numerical values are the same, the game is over and the deal is declared a tie. If the numerical value of the first player's hand is not the same as the value of the second player's hand, another card is dealt to the player having the lower numerical value. Again the total numerical values are compared. If a tie now exists, again the game is over and the hand is declared a tie. The dealing of cards to the hand having the lower total numerical value continues until a tie exists or until one of the hands exceeds a predetermined value. Once one of the hands exceeds the predetermined value, the other hand wins. In one variation of this game, any time one of the hands achieves the exact predetermined numerical value, the game ends with that hand being declared the winner. Players may wager on whether the first player's hand, the second player's hand or the tie will win.

36 Claims, No Drawings

METHOD OF PLAYING A WAGERING CASINO-TYPE CARD GAME

This invention relates to a card game, and more particularly to a card game involving only two hands and cards are dealt until one hand exceeds a predetermined value, in which case the other hand is the winner. If at any time the hands tie, the game is over with neither hand winning and the tie hand wins.

BACKGROUND OF THE INVENTION

There are a number of casino-type card games that utilize standard playing cards. Typical of such games are the many variations of poker, including draw poker, stud poker, Texas hold 'em, low-ball and others. These games basically involve each player receiving a hand of cards and attempting to achieve a better hand than the hand achieved by the other players. One or a series of bets are made to a common pot and the player with the best hand wins the common pot. These games require that the player have a certain level of skill in determining how to bet based on the type of hand the player has received. The player must know the value rank of the hands and the player must assess his hand against the hands held by the other players to determine his likelihood of success. In games involving the draw of additional cards, the player must be familiar with the stratagems relating to which cards to hold and the possibilities of improving his hand on the draw. These games are quite complicated to play and discourage the novice player from participating against more highly skilled players.

Another casino-type game involving standard playing cards is Twenty-One. A player and a dealer each are dealt two cards and may continue to receive additional cards in attempt to come closest to, without going over, the total of 21. The player may only wager on his own hand and if the dealer's hand wins, the player loses. Again players must be familiar with standard strategy such as which hands to stand pat and which hands to take additional cards. If there is more than one player at the Twenty-One table, the manner in which one of the players plays his cards can affect the winning or losing by the other players. Again novice players are often intimidated by Twenty-One for fear of not following the proper strategy and being subject to opprobriums and invectives from the other players.

Yet another casino-type game utilizing standard playing cards is Baccarat. This game is played according to set rules and the player has no control over how the cards are selected. There are no stratagems that the player must know. A Banker receives two cards and a Player receives two cards. According to preselected rules, a winner is determined.

It is an object of the present invention to provide a card game involving two hands in which no player strategy affects the outcome of the game.

It is a feature of the present invention to permit a bettor to select which of two hands he thinks will win or whether the game will end in a tie.

It is an advantage of the present invention that a bettor's chances of winning are not affected by any strategy in the play of the game and that the bettor can win on any of three possibilities—the first player's hand, the second player's hand or a tie game.

SUMMARY OF THE INVENTION

The method of playing a game utilizes one or more decks of cards. A standard deck of cards can be used, or all the face cards can be eliminated or one or more Jokers can be added to the deck. One card is dealt to a first player and one card is dealt to a second player. The numerical value of the first player's card is compared to the numerical value of the second player's card. If the numerical values are the same, the game is over and the deal is declared a tie (and the tie is declared a winner). If the numerical value of the first player's hand is not the same as the value of the second player's hand, another card is dealt to the player having the lower numerical value. Again the total numerical values are compared. If a tie now exists, again the game is over and the hand is declared a tie. The dealing of cards to the hand having the lower total numerical value continues until a tie exists or until one of the hands exceeds a predetermined value. Once one of the hands exceeds the predetermined value, the other hand wins. If the game is played as a casino-type game, a bettor will win if he has wagered on the winning hand or if he has wagered that the hand will end in a tie, either as a single bet or a combination of bets per hand. In one variation of this game, any time one of the hands achieves the exact predetermined total numerical value, the game ends with that hand being declared the winner.

DETAILED DESCRIPTION OF THE PREFERRED EMBODIMENTS

The method of playing the game of the present invention utilizes a standard deck of cards. In determining the value of the cards during the play of the game, the numerical face values of the cards are used. The suit values are ignored. In a preferred embodiment of the present invention, all Kings, Queens and Jacks are removed from the deck resulting in a deck of cards comprising forty cards. This results in a deck of cards to be used comprising the Ace, 2, 3, 4, 5, 6, 7, 8, 9 and 10 of Spades; the Ace, 2, 3, 4, 5, 6, 7, 8, 9 and 10 of Hearts; the Ace, 2, 3, 4, 5, 6, 7, 8, 9 and 10 of Diamonds and the Ace, 2, 3, 4, 5, 6, 7, 8, 9 and 10 of Clubs. In a preferred embodiment of the present invention, the Ace has numerical a value of one.

The deck is shuffled and a card is dealt to a first player and another card is dealt to a second player. The numerical total of the first player's card is compared to the numerical value of the second player's card. For example, if the first player has a 10, the numerical value of the first player's hand is 10. If the second player has an Ace, the numerical value of the second player's hand is 1.

If the numerical values are the same, the game is over and the deal is declared a tie.

If the numerical value of the first player's hand is not the same as the value of the second player's hand, another card is dealt to the player having the lower numerical value. In the example, the second player would receive an additional card. Again the numerical values are compared. For example, if the second player's next card is a 7, his numerical value will then be 8, no tie exists and the second player still has the lower numerical value so the second player receives the next card.

If at any point a tie exists, the game is over and the hand is declared a tie.

The dealing of cards to the hand having the lower value continues until a tie exists or until one of the hands exceeds a predetermined value. Once one of the hands exceeds the predetermined value, the other hand wins. In a preferred embodiment of game of the present invention, the predetermined value is selected from predetermined values in the range of 18 through 26. In the most preferred embodiment, the predetermined value is 22.

In one variation of this game, any time one of the hands achieves the exact predetermined numerical value, the game ends with that hand being declared the winner.

There are numerous variations that may be made to the game of the present invention. The face cards (Kings, Queens and Jacks) may be included in the deck, each face card is preferably given a value of 0. This variation would increase the possibility that the game would end in a tie—particularly at the point of the initial deal.

Jokers may also be added to the deck. In the preferred embodiment, two Jokers are used per deck and each Joker is given a numerical point value of ½. This variation decreases the probabilities of the game ending in a tie and increases the probabilities that one cf the players will win the hand.

The game may also be played using multiple decks of cards dealt from shoe or by hand. In the preferred embodiment, two Jokers are added for each deck of cards that are used in the game.

The game of the present invention can be played as a "casino-type" game. One or more bettors may place a wager on whether the first player will win, whether the second player will win or whether the game will end in a tie. A bettor receives preselected odds on the amount of his wager if he selects the correct outcome of the game. In a preferred embodiment of the casino-type version of the present invention, the preselected odds are two-to-one if either the first or second player wins and one-to-one if the game ends in a tie.

In another preferred embodiment of the present invention, the game is player with an Oriental orientation. The first player's hand is designated the YIN hand and the second player's hand is designated the YANG hand. A tie hand is designated as a YO. The cards have Oriental figures and symbols depicted thereon and the Oriental characters representing the numerical values are used. In the casino-type version of the game, a table layout can also be provided using similar Oriental figures, symbols and characters. The bettor then can wager on whether YIN, YANG or YO will win.

In the betting version of the game of the present invention, there are also many variations that can be used.

The above described "casino-type" versions of the game of the present invention have been described in the context of a casino or gaming establishment acting as the house for purposes of paying off winning wagers and collecting losing wagers. Many jurisdictions that allow wagering on card games, in particular California, do not allow the gaming establishment to participate in any profits that are generated by the card game. The gaming establishment may only charge a fee for the use of the facilities and for providing a dealer and the cards.

The game of the present invention can also be played in a "card-room" version in which the gaming establishment does not pay the winning players and does not collect from the losing players. A particular bettor is designated as the "dealer" or the "bank" for a particular game or series of games and that bettor pays all winning wagers and collects all losing wagers from the other bettors. As is conventional, there may be a limit to the amount of money any one bettor may lose as the "bank." The person designated as the bank will vary from bettor to bettor according to criteria established by the gaming establishment.

Because the game is played by means of a preestablished set rules for receiving the cards, no player strategy is involved. The bettor merely selects which of the three possible outcomes might occur and the game is played out without any further need for the bettor to make any decisions. Thus, a novice bettor is not at any disadvantage against an experienced bettor and no bettor's outcome is affected by the wager of another bettor. The rules are simple, straightforward and easy to learn and a new bettor is not intimidated by other bettors at the table or by any complicated judgment or strategy that must be employed.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a game utilizing at least one deck of cards, each card having a numerical value assigned thereto, comprising:

a) dealing a card to a first player and determining the numerical value of that card, the card comprising the first player's hand, b) dealing another card to a second player and determining the numerical value of that card, the card comprising the second player's hand, c) comparing the numerical value of the first player's hand to the numerical value of the second player's hand, 1) if the numerical value of the first player's hand is the same as the numerical value of the second player's hand, declaring that the game ends in a tie, or 2) if the numerical value of the first player's hand is not the same as the numerical value of the second player's hand, dealing another card to be added to the player's hand having the lower total numerical value, and d) comparing the numerical value of the first player's hand to the numerical value of the second player's hand and continuing to deal one card at a time to the player with the hand having the lower total numerical value until 1) the numerical value of the first player's hand is the same as the numerical value of the second player's hand, in which case the game is declared a tie, or 2) when the total numerical value one of the player's hands exceeds a predetermined numerical value, declaring one of the players the winner.

2. The method of claim 1 including using standard playing cards as the deck of cards and assigning a numerical value of 0 to each King, Queen and Jack, assigning a numerical value of 1 to each Ace and assigning a numerical value of its normal face amount to each remaining card.

3. The method of claim 2 including using at least one Joker in the deck of cards and assigning a numerical value of ½ to each Joker.

4. The method of claim 1 including using as the deck of cards a group of forty cards comprising an Ace, 2, 3, 4, 5, 6, 7, 8, 9 and 10 of Spades; an Ace, 2, 3, 4, 5, 6, 7, 8, 9 and 10 of Hearts; an Ace, 2, 3, 4, 5, 6, 7, 8, 9 and 10 of Diamonds and an Ace, 2, 3, 4, 5, 6, 7, 8, 9 and 10 of Clubs as the deck of cards and assigning a numerical value of 1 to each Ace and assigning a numerical value of its normal face amount to each remaining card.

5. The method of claim 4 including using at least one Joker in the deck of cards and assigning a numerical value of ½ to each Joker.

6. The method of claim 1 including assigning the predetermined value a specific numerical value selected from the numerical values in the range of 18 through 26.

7. The method of claim 6 including assigning the predetermined value a numerical value of 22.

8. The method of claim 1 including declaring the player with the hand having the lower total numerical value when the game ends to be the winner.

9. The method of claim 1 including declaring a player the winner whenever the numerical value of that player's hand equals the predetermined value.

10. The method of claim 9 including declaring the player with the hand having the lower total numerical value when the game ends to be the winner, if neither player achieves the exact predetermined value.

11. The method of claim 9 including assigning the predetermined value a specific numerical value selected from the numerical values in the range of 18 through 26.

12. The method of claim 10 including assigning the predetermined value a numerical value of 22.

13. A method of playing a casino-type game utilizing at least one deck of cards, each card having a numerical value assigned thereto, comprising:

a) a bettor wagering on whether a first player or a second player will win, b) dealing a card to a first player and determining the numerical value of that card, the card comprising the first player's hand, c) dealing another card to a second player and determining the numerical value of that card, the card comprising the second player's hand, d) comparing the numerical value of the first player's hand to the numerical value of the second player's hand, 1) if the numerical value of the first player's hand is the same as the numerical value of the second player's hand, declaring that the game ends in a tie, or 2) if the numerical value of the first player's hand is not the same as the numerical value of the second player's hand, dealing another card to be added to the player's hand having the lower total numerical value, and e) comparing the numerical value of the first player's hand to the numerical value of the second player's hand and continuing to deal one card at a time to the player with the hand having the lower total numerical value until 1) the numerical value of the first player's hand is the same as the numerical value of the second player's hand, in which case the game is declared a tie, or 2) when the total numerical value one of the player's hands exceeds a predetermined numerical value, declaring the player with the hand having the lower total numerical value to be the winner, and f) paying the bettor a preselected amount if the bettor has bet on the winning player.

14. The method of claim 13 including using standard playing cards as the deck of cards and assigning a numerical value of 0 to each King, Queen and Jack, assigning a numerical value of 1 to each Ace and assigning a numerical value of its normal face amount to each remaining card.

15. The method of claim 14 including using at least one Joker in the deck of cards and assigning a numerical value of ½ to each Joker.

16. The method of claim 13 including using as the deck of cards a group of forty cards comprising an Ace, 2, 3, 4, 5, 6, 7, 8, 9 and 10 of Spades; an Ace, 2, 3, 4, 5, 6, 7, 8, 9 and 10 of Hearts; an Ace, 2, 3, 4, 5, 6, 7, 8, 9, and 10 of Diamonds and an Ace, 2, 3, 4, 5, 6, 7, 8, 9 and 10 of Clubs as the deck of cards and assigning a numerical value of 1 to each Ace and assigning a numerical value of its normal face amount to each remaining card.

17. The method of claim 16 including using at least one Joker in the deck of cards and assigning a numerical value of ½ to each Joker.

18. The method of claim 13 including assigning the predetermined value a specific numerical value selected from the numerical values in the range of 18 through 26.

19. The method of claim 18 including assigning the predetermined value a numerical value of 22.

20. The method of claim 13 including declaring a player the winner whenever the numerical value of that player's hand equals the predetermined value.

21. The method of claim 20 including assigning the predetermined value a specific numerical value selected from the numerical values in the range of 18 through 26.

22. The method of claim 21 including assigning the predetermined value a numerical value of 22.

23. The method of claim 13 including paying the bettor the preselected amount of two-to-one odds based on the amount of the wager made by the bettor.

24. The method of claim 13 further including allowing the bettor to also wager on whether the hand will end in a tie and paying the bettor a second preselected amount if the hand does end in a tie.

25. The method of claim 24 including paying the bettor the second preselected amount of one-to-one odds based on the amount of the wager made by the bettor.

26. A method of playing a casino-type game utilizing at least one deck of cards, each card having a numerical value assigned thereto, comprising:

a) a bettor wagering on whether a first player will win, whether a second player will win, or whether the game will end in a tie, b) dealing a card to the first player and determining the numerical value of that card, the card comprising the first player's hand, c) dealing another card to the second player and determining the numerical value of that card, the card comprising the second player's hand, d) comparing the numerical value of the first player's hand to the numerical value of the second player's hand, 1) if the numerical value of the first player's hand is the same as the numerical value of the second player's hand, declaring that the game ends in a tie and that the tie is the winning bet, or 2) if the numerical value of the first player's hand is not the same as the numerical value of the second player's hand, dealing another card to be added to the player's hand having the lower total numerical value, and e) comparing the numerical value of the first player's hand to the numerical value of the second player's hand and continuing to deal one card at a time to the player with the hand having the lower total numerical value until 1) the numerical value of the first player's hand is the same as the numerical value of the second player's hand, in which case the game is declared a tie, and the tie is declared to be the winning bet or 2) when the total numerical value one of the player's hands exceeds a predetermined numerical value, declaring the player with the hand having the lower total numerical value to be the winner, and f) paying the bettor a preselected amount if the bettor has bet on the winning player or has bet that the hand will end in a tie.

27. The method of claim 26 including using standard playing cards as the deck of cards and assigning a numerical value of 0 to each King, Queen and Jack, assigning a numerical value of 1 to each Ace and assigning a numerical value of its normal face amount to each remaining card.

28. The method of claim 27 including using at least one Joker in the deck of cards and assigning a numerical value of ½ to each Joker.

29. The method of claim 26 including using as the deck of cards a group of forty cards comprising an Ace, 2, 3, 4, 5, 6, 7, 8, 9 and 10 of Spades; an Ace, 2, 3, 4, 5, 6, 7, 8, 9 and 10 of Hearts; an Ace, 2, 3, 4, 5, 6, 7, 8, 9, and 10 of Diamonds and an Ace, 2, 3, 4, 5, 6, 7, 8, 9 and 10 of Clubs as the deck of cards and assigning a numerical value of 1 to each Ace and assigning a numerical value of its normal face amount to each remaining card.

30. The method of claim 29 including using at least one Joker in the deck of cards and assigning a numerical value of ½ to each Joker.

31. The method of claim 30 including assigning the predetermined value a specific numerical value selected from the numerical values in the range of 18 through 26.

32. The method of claim 31 including assigning the predetermined value a numerical value of 22.

33. The method of claim 26 including declaring a player the winner whenever the numerical value of that player's hand equals the predetermined value.

34. The method of claim 33 including assigning the predetermined value a specific numerical value selected from the numerical values in the range of 18 through 26.

35. The method of claim 33 including assigning the predetermined value a numerical value of 22.

36. The method of claim 26 including paying the bettor the preselected amount of two-to-one odds based on the amount of the wager made by the bettor if the bettor has successfully wagered that a particular player's hand will win and paying the bettor the preselected amount of one-to-one odds based on the amount of the wager made by the bettor if the bettor has successfully wagered that the game will end in a tie.

* * * * *